US008317570B2

(12) United States Patent
Kundig

(10) Patent No.: US 8,317,570 B2
(45) Date of Patent: Nov. 27, 2012

(54) CONTROL OF A GRINDING DEVICE WITH GRINDING ROLLERS ON WINDING SHAFTS

(75) Inventor: Hans Rudolf Kundig, Wetzikon (CH)

(73) Assignee: Kundig AG, Wetzikon (CH)

( * ) Notice: Subject to any disclaimer, the term of this patent is extended or adjusted under 35 U.S.C. 154(b) by 1311 days.

(21) Appl. No.: 10/569,161

(22) PCT Filed: Aug. 16, 2004

(86) PCT No.: PCT/CH2004/000508

§ 371 (c)(1),
(2), (4) Date: Feb. 11, 2011

(87) PCT Pub. No.: WO2005/018876

PCT Pub. Date: Mar. 3, 2005

(65) Prior Publication Data

US 2011/0130078 A1 Jun. 2, 2011

(30) Foreign Application Priority Data

Aug. 22, 2003 (CH) ..... 1438/03

(51) Int. Cl.
*B24B 49/00* (2012.01)
*B24B 51/00* (2006.01)

(52) U.S. Cl. ..... 451/5; 451/9; 451/10; 451/304

(58) Field of Classification Search ..... 451/5, 8, 451/9, 10, 11, 296, 299, 304
See application file for complete search history.

(56) References Cited

U.S. PATENT DOCUMENTS

| | | | | | |
|---|---|---|---|---|---|
| 4,416,090 | A | * | 11/1983 | Jonasson | 451/300 |
| 4,601,134 | A | * | 7/1986 | Hessemann | 451/300 |
| 4,839,994 | A | * | 6/1989 | Heesemann | 451/6 |
| 5,472,368 | A | * | 12/1995 | Zollig | 451/8 |
| 5,913,716 | A | * | 6/1999 | Mucci et al. | 451/59 |
| 5,951,377 | A | * | 9/1999 | Vaughn et al. | 451/49 |
| 6,068,542 | A | * | 5/2000 | Hosokai | 451/37 |
| 6,102,781 | A | * | 8/2000 | Greathouse et al. | 451/59 |
| 6,290,570 | B1 | * | 9/2001 | Heesemann | 451/5 |
| 6,589,105 | B2 | * | 7/2003 | Young et al. | 451/296 |
| 6,634,935 | B2 | * | 10/2003 | Young et al. | 451/168 |
| 6,746,320 | B2 | * | 6/2004 | Krusell et al. | 451/302 |

FOREIGN PATENT DOCUMENTS

| | | | |
|---|---|---|---|
| DE | 8630816 | U | 12/1988 |
| DE | 20106234 | U | 6/2001 |
| EP | 0803324 | A | 10/1997 |
| WO | 0202270 | A | 1/2002 |

* cited by examiner

*Primary Examiner* — Timothy V Eley
(74) *Attorney, Agent, or Firm* — Oliff & Berridge, PLC

(57) ABSTRACT

The invention describes a control unit for a sanding machine, which winds and unwinds the abradant paper over a contact device. This control unit continuously detects the position of one or more of these sanding machines, the abradant unwinding, the movement of the transport system and the position of the workpiece. These parameters are used to regulate the sanding machine(s) in such a way that the workpieces are fed through and the sanding operation executed without interruption.

3 Claims, 1 Drawing Sheet

CONTROL OF A GRINDING DEVICE WITH GRINDING ROLLERS ON WINDING SHAFTS

Figure 1:
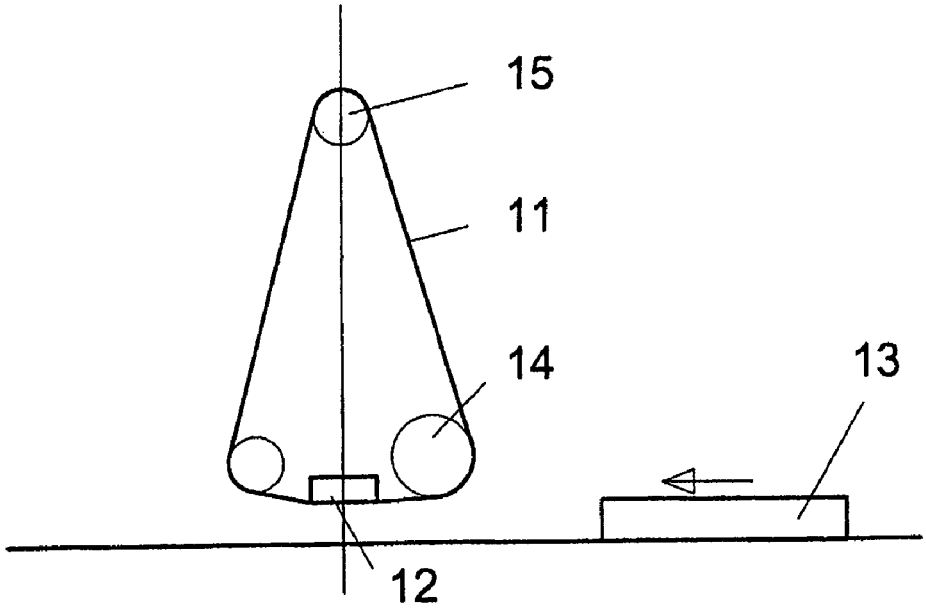
Figure 2:
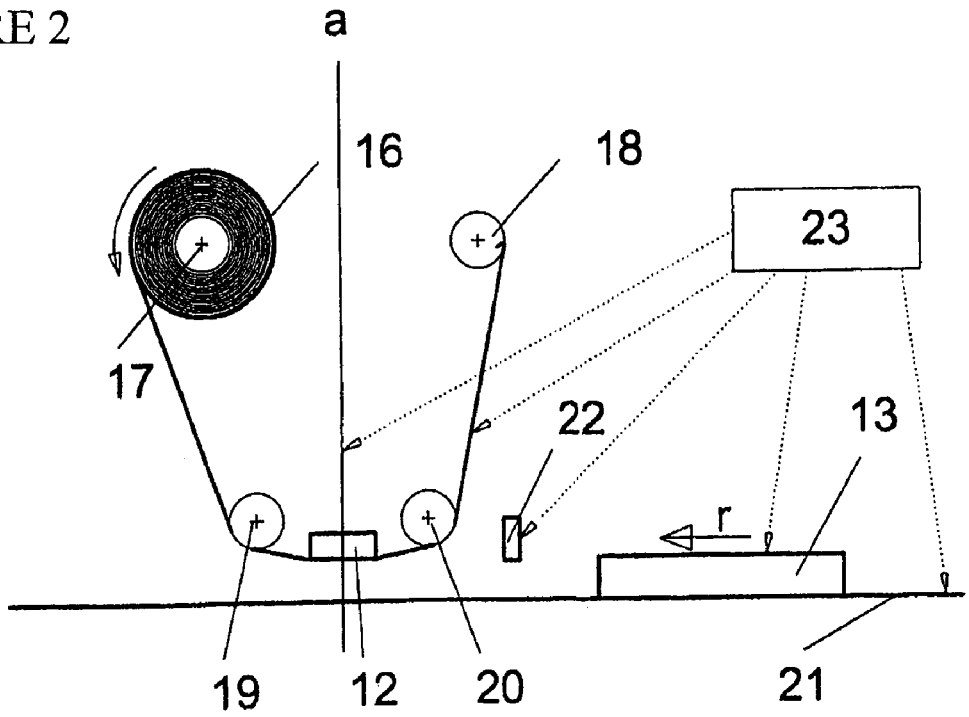

The invention describes the use of a control unit on a sanding machine with rolls which, to perform the sanding operation, are wound around rollers and an intermediate contact device. The subject of the invention is the connection of such a sanding machine to a control system in such a way that the workpieces can be fed through nonstop and the sanding process can occur without interruption.

The invention is illustrated by:

Drawing 1, with the projection of a form of standard sanding system with flexible abradant, comprising an endless sanding belt (11), which rotates around a contact device (12) longitudinally aligned with the workpiece transport system (13), around a drive roller (14) and a deflecting roller (15).

Drawing 2 with the projection of the type of sanding system at the base of the invention, comprising a roll of flexible abradant (16) on a winding axis (17) inclined to the feed direction and rotating in the feed direction r, a rotating winding roller (18) parallel to it, and a contact device (12) running at an angle to the workpiece transport (13) between the two shafts and with pre and post-positioned deflecting rollers (19, 20), a feed system (21), and a machine infeed with a barrier regulated by the control unit (23) described in the invention.

The standard form of flexible abradant used in throughfeed surface sanding is the endless belt, commonly configured as shown in Drawing 1. The disadvantages of the endless belts are their relatively complicated and costly packaging, their bulky shape for transport and storage, short application times due to the limits placed on their lengths, and their qualitative imperfections, due to their attachment points and rapid repetition of grain imperfections on the piece. Since their use to date has been indispensable, a relatively high sanding speed has been necessary for the most common type of workpieces, and therefore the need for a correspondingly rapid, continuous supply of abradant for the sanding process, and it has not been possible to change the sanding direction and obtain qualitatively identical results on conventional workpieces (e.g. wood, e.g. due to its fibrous structure). Only the continuous winding of the sanding belt makes nonstop workplace feed possible.

The sanding machine which is the subject of the invention consists of an unwinding roller (17), on which a roll (16) of abradant on backing material, usually sanding paper, is placed, a contact device (12) and winding roller (18), which takes up the unwound roll of abradant. The contact device is usually a contact roller or a bar that is continuous or made up of segments; i.e. a so-called sanding block. The sanding paper is wound backwards and forwards until the abradant is completely consumed, whereby after every pass the winding roller becomes the unwinding roller, and vice-versa. Such a sanding device was described by Paul Ernst (Patent GB 1484851, Aug. 9, 1977).

Subject of the invention is the combination of the sanding device described above with a control system (23), which solves the problem of the discontinuity in the feed and the sanding operations.

The sanding device in the form described in Paul Ernst's patent claim in practice can only be used for sanding small batches or single pieces. After reaching the end of the abradant roll, this machine cannot continue with workpiece feed until the rotation direction has been reversed. For materials which, due to their structure, must always be sanded in the same direction as the feed direction (e.g. wood, usually in the contrary direction), the entire roll of abradant must first be rewound to its original position before work may continue. For the usual abrasive speeds for conventional materials (e.g. wood around 20 m/sec) and the common abradant roll lengths (round 50-200 meters) such a machine experiences a feed interruption about every 2-8 seconds. This limitation is the reason that these machines have not been widely disseminated.

This invention takes into account the changing demands which new materials, surfaces and sanding processes involve. These (e.g. the sanding of painted surfaces) often involve homogeneous surfaces, on which sanding patterns remain the same even with opposing sanding directions. In addition, considerably lower sanding intensities are required, which in turn require lower sanding speeds (e.g. 5 m/sec) with consequently extended roll throughtimes. Furthermore and above all electronic control can regulate the machine feed as a function of the abradant preparation; i.e. the problem of discontinuity in the abradant feed has been solved.

The control system (23), integral part of the invention, can manage various parameters, namely (the following list is not all-inclusive):

I. Rotation Direction of the Winding Shafts

If the sanding result is independent of the sanding direction (inclined, longitudinal, with or contrary to the feed direction), it is sufficient that the winding shafts be arranged as shown in Drawing 2, and when the sanding paper roll reaches the end, the rotation direction be simply reversed. This procedure is sufficient for many homogeneous, i.e. non-fibrous materials.

II. Positioning of the Sanding Device Itself

If the sanding direction needs to be constant for all workpieces of a series, then the entire sanding unit is turned at the end of the abradant roll end, in order to maintain the same direction. The arrangement shown in Drawing 2 allows the sanding unit to be rotated for this purpose 180 degrees around axis a of the feed direction. The sanding direction, however, can be rotated to any angle, whether in inclined, lateral or longitudinal alignment.

III. Use of Single Assemblies

If the sanding direction needs to be constant, a number of sanding units—in the following referred to as assemblies—can be employed. As One assembly is engaged in the sanding process, a second (after reaching the end of the roll) rewinds the abradant rapidly, or the assembly is turned. The control system manages the respective sanding, rewinding and turning operations for the various assemblies.

IV. Positioning of the Workpiece

Mechanically, optically or in another way, the position of the workpiece is detected and its feed through the machine controlled by the machine itself or via the contact device (12). This can be, for example, a regulating bather (22) at the infeed (to synchronise with the winding operation) and/or through regulating the feed mechanism itself.

V. Workpiece Transport Speed

Depending on the position of the workpiece relative to the winding mechanism or the abradant, the speed of the transport system (21) is correspondingly regulated, i.e. raised/lowered/stopped/started.

VI. Winding of the Abradant

The control system calculates the remaining abradant on the roll and time till changeover, and calculates the optimal braking time of the winding, in accordance with the use of single assemblies (see III). The control unit can optimise the time used for the sanding process via the winding speed.

Only the combination of the sanding machine on the principle of winding rollers with a control unit as described here can produce a significant improvement in the efficiency of the sanding process with practical results.

SUMMARY

The invention describes a control unit (23) for a sanding machine, which winds and unwinds the abradant paper (16) over a contact device (12). This control unit (23) continuously detects the position of one or more of these sanding machines, the abradant unwinding, the movement of the transport system (21) and the position of the workpiece (13). These parameters are used to regulate the sanding machine(s) in such a way that the workpieces (13) are fed through and the sanding operation executed without interruption.

I claim:

1. A control unit configured to operate a sanding machine utilizing one or a plurality of sanding units, each sanding unit configured to wind and unwind a backing of coated abrasives over a contact mechanism, the control unit being configured to detect, control and adjust a position of at least one of the sanding units, the winding and unwinding of the backing of coated abrasives of at least one of the sanding units, feed movement and positioning of a workpiece so as to continuously perform a sanding operation in a constant direction.

2. The control unit of claim 1, wherein the control unit is further configured to rotate at least one of the sanding units 180 degrees about an axis of rotation.

3. The control unit of claim 1, wherein the control unit is further configured to detect, control and adjust the winding and unwinding of the backing of coated abrasives of more than one of the sanding units.

* * * * *